US011939648B1

(12) United States Patent
Holgate et al.

(10) Patent No.: US 11,939,648 B1
(45) Date of Patent: Mar. 26, 2024

(54) SELECTIVE OXIDE-FORMING ALLOY, COATING FORMED FROM AND MACHINE COMPONENT INCLUDING SAME

(71) Applicants: General Electric Company, Schenectady, NY (US); The Regents of the University of California, Oakland, CA (US)

(72) Inventors: Collin Scott Holgate, Santa Barbara, CA (US); Tresa Marie Pollock, Santa Barbara, CA (US); Carlos Gerardo Levi, Santa Barbara, CA (US); Akane Suzuki, Ballston Spa, NY (US)

(73) Assignees: General Electric Company, Schenectady, NY (US); The Regents of the University of California, Oakland, CA (US)

( * ) Notice: Subject to any disclaimer, the term of this patent is extended or adjusted under 35 U.S.C. 154(b) by 0 days.

(21) Appl. No.: 18/121,940

(22) Filed: Mar. 15, 2023

(51) Int. Cl.
*C22C 30/00* (2006.01)

(52) U.S. Cl.
CPC ..... *C22C 30/00* (2013.01)

(58) Field of Classification Search
None
See application file for complete search history.

(56) References Cited

U.S. PATENT DOCUMENTS 7,981,520 B2 7/2011 Bewlay et al.
8,039,116 B2 10/2011 Bewlay et al.

OTHER PUBLICATIONS

Ghadyani et al., "Microstructures and Isothermal Oxidation of the Alumina Scale Forming Nb1.7Si2.4Ti2.4Al$_3$Hf0.5 and Nb1.3Si2.4Ti2.4Al3.5Hf0.4 Alloys," Materials, published Jan. 10, 2019, 12, 222; doi:10.3390/ma120202022, 33 pages.

Ghadyani et al., "Microstructures and Isothermal Oxidation of the Alumina Scale Forming Nb1.45Si2.7Ti2.25Al3.25Hf0.35 and Nb1.35Si2.3Ti2.3AI3.7Hf0.35 Alloys," Materials, published Mar. 5, 2019, 12, 759; doi:10.3390/ma12050759, 26 pages.

*Primary Examiner* — Brian D Walck
(74) *Attorney, Agent, or Firm* — James Pemrick; Charlotte Wilson; Hoffman Warnick LLC

(57) ABSTRACT

A selective oxide-forming alloy, a coating formed from, and a machine component including the coating are provided. The selective oxide-forming alloy includes between atomic percent and 26 atomic percent silicon (Si), between 21 atomic percent and 27 atomic percent titanium (Ti), between 30 atomic percent and 39 atomic percent aluminum (Al), between 2 atomic percent and 10 atomic percent hafnium (Hf), and a balance of niobium (Nb).

20 Claims, 10 Drawing Sheets
(5 of 10 Drawing Sheet(s) Filed in Color)

SELECTIVE OXIDE-FORMING ALLOY, COATING FORMED FROM AND MACHINE COMPONENT INCLUDING SAME

STATEMENT REGARDING FEDERALLY SPONSORED RESEARCH & DEVELOPMENT

The United States Government may have certain rights in this invention pursuant to Contract No. DE-AR0001420, awarded by United States Department of Energy.

TECHNICAL FIELD

The disclosure relates generally to alloys, coatings formed from the alloys, and machine components including the coatings. More particularly, the disclosure relates to coatings formed from a selective oxide-forming alloy (also referred to as "selective oxide-forming coating" and used interchangeably with throughout the disclosure) that is suitable for Nb-based materials. The selective oxide-forming coatings have properties that permit the Nb-based materials to find applications in high temperature components such as turbine components.

BACKGROUND

Gas turbines (and their components) such as, but not limited to, aeronautical turbines, land-based turbines, marine-based turbines, and the like, have typically been formed from superalloys, often based on nickel (Ni). Turbine components formed from Ni-based superalloys generally exhibit desirable mechanical, chemical and physical properties under the high temperature, high stress, and high-pressure conditions generally encountered during gas turbine operation. For example, turbine components, such as an airfoil, in modern jet engines can reach temperatures as high as about 1050° C., which can be as high as approximately 85% of the melting temperatures (T m) of many Ni-based superalloys.

Because Ni-based superalloys have provided the level of performance desired in such applications, the development of such Ni-based superalloys has been widely explored. Consequently, the field has matured and few significant improvements have been realized in this area in recent years. In the meantime, efforts have been made to develop alternative turbine component materials. These alternate materials include Nb-based refractory metal intermetallic composites (hereinafter "RMICs"). Most RMICs have melting temperatures of about 1700° C. If RMICs could be used at about 80% of their melting temperatures, they would have potential use in applications in which the temperature exceeds the current service limit of Ni-based superalloys.

Examples of such RMIC's include various Nb silicide-based in-situ composites. Nb silicide-based in-situ composites possess a useful range of mechanical properties, such as low-temperature toughness as well as reasonable high-temperature strength and creep resistance. However, an impediment to the development of the Nb silicide-based in-situ composites and Nb-based alloys for high-temperature applications including turbines and turbine components is that their environmental resistance, e.g., oxidation behavior, is not sufficiently adequate, especially in order to meet the demanding requirements imposed for applications in hot-section engine components such as airfoils, rotors, nozzles, shrouds, and exhaust components.

BRIEF DESCRIPTION

All aspects, examples and features mentioned below can be combined in any technically possible way.

An aspect of the disclosure provides an alloy that comprises between 20 atomic percent and 26 atomic percent silicon (Si), between 21 atomic percent and 27 atomic percent titanium (Ti), between 30 atomic percent and 39 atomic percent aluminum (Al), between 2 atomic percent and 10 atomic percent hafnium (Hf), and a balance of niobium (Nb).

Another aspect of the disclosure includes the preceding aspects, and where the alloy comprises between 20 atomic percent and 24 atomic percent silicon (Si), between 23 atomic percent and 27 atomic percent titanium (Ti), between 30 atomic percent and 37 atomic percent aluminum (Al), between 4 atomic percent and 7 atomic percent hafnium (Hf), and a balance of niobium (Nb).

Another aspect of the disclosure includes any of the preceding aspects, and where the alloy comprises between 20 atomic percent and 24 atomic percent silicon (Si), between 21 atomic percent and 27 atomic percent titanium (Ti), between 32 atomic percent and 39 atomic percent aluminum (Al), between 5 atomic percent and 7 atomic percent hafnium (Hf), and a balance of niobium (Nb).

Another aspect of the disclosure includes any of the preceding aspects, and where the alloy comprises between 22 atomic percent and 24 atomic percent silicon (Si), between 23 atomic percent and 25 atomic percent titanium (Ti), between 35 atomic percent and 37 atomic percent aluminum (Al), between 5 atomic percent and 7 atomic percent hafnium (Hf), and a balance of niobium (Nb).

Another aspect of the disclosure includes any of the preceding aspects, and where the alloy comprises about 23 atomic percent silicon (Si), about 24 atomic percent titanium (Ti), about 36 atomic percent aluminum (Al), about 5 atomic percent hafnium (Hf), and a balance of niobium (Nb).

Another aspect of the disclosure includes any of the preceding aspects, and where the alloy selectively forms a substantially continuous aluminum oxide layer across a surface of the alloy when the alloy is exposed to an oxidation environment at 1200° C. or higher.

Another aspect of the disclosure includes any of the preceding aspects, and where the alloy has a microstructure including a (Nb, Ti)$Al_3$ phase and a (Nb, Ti, Hf)$_5Si_4$ phase.

Another aspect of the disclosure includes any of the preceding aspects, and where wherein the (Nb, Ti)$Al_3$ phase includes between 6 atomic percent and 26 atomic percent niobium (Nb), between 1 atomic percent and 5 atomic percent silicon (Si), between 10 atomic percent and 16 atomic percent titanium (Ti), between 71 atomic percent and 77 atomic percent aluminum (Al), and about 1 atomic percent hafnium (Hf).

Another aspect of the disclosure includes any of the preceding aspects, and where the (Nb, Ti, Hf)$_5Si_4$ phase includes between 13 atomic percent and 19 atomic percent niobium (Nb), between 42 atomic percent and 48 atomic percent silicon (Si), between 19 atomic percent and 25 atomic percent titanium (Ti), between 1 atomic percent and 3 atomic percent aluminum (Al), and between 12 atomic percent and 18 atomic percent hafnium (Hf).

An aspect of the disclosure provides a coating composition comprising: an alloy including between 20 atomic percent and 26 atomic percent silicon (Si), between 21 atomic percent and 27 atomic percent titanium (Ti), between 30 atomic percent and 39 atomic percent aluminum (Al), between 2 atomic percent and 10 atomic percent hafnium (Hf), and a balance of niobium (Nb).

Another aspect of the disclosure includes any of the preceding aspects, and where the alloy comprises between 20 atomic percent and 24 atomic percent silicon (Si), between 23 atomic percent and 27 atomic percent titanium (Ti), between 30 atomic percent and 37 atomic percent aluminum (Al), between 4 atomic percent and 7 atomic percent hafnium (Hf), and a balance of niobium (Nb).

Another aspect of the disclosure includes any of the preceding aspects, and where the alloy comprises between 20 atomic percent and 24 atomic percent silicon (Si), between 21 atomic percent and 27 atomic percent titanium (Ti), between 32 atomic percent and 39 atomic percent aluminum (Al), between 5 atomic percent and 7 atomic percent hafnium (Hf), and a balance of niobium (Nb).

Another aspect of the disclosure includes any of the preceding aspects, and where the coating includes a substantially continuous aluminum oxide layer across a surface of the alloy when being exposed to a temperature of 1200° C. or higher.

Another aspect of the disclosure includes any of the preceding aspects, and where the alloy has a microstructure including a $(Nb, Ti)Al_3$ phase and a $(Nb, Ti, Hf)_5Si_4$ phase.

An aspect of the disclosure provides a machine component comprising: a substrate having a coating thereon, the coating includes between 20 atomic percent and 26 atomic percent silicon (Si), between 21 atomic percent and 27 atomic percent titanium (Ti), between 30 atomic percent and 39 atomic percent aluminum (Al), between 2 atomic percent and 10 atomic percent hafnium (Hf), and a balance of niobium (Nb).

Another aspect of the disclosure includes any of the preceding aspects, and where the alloy comprises between 20 atomic percent and 24 atomic percent silicon (Si), between 23 atomic percent and 27 atomic percent titanium (Ti), between 30 atomic percent and 37 atomic percent aluminum (Al), between 4 atomic percent and 7 atomic percent hafnium (Hf), and a balance of niobium (Nb).

Another aspect of the disclosure includes any of the preceding aspects, and where the alloy comprises between 20 atomic percent and 24 atomic percent silicon (Si), between 21 atomic percent and 27 atomic percent titanium (Ti), between 32 atomic percent and 39 atomic percent aluminum (Al), between 5 atomic percent and 7 atomic percent hafnium (Hf), and a balance of niobium (Nb).

Another aspect of the disclosure includes any of the preceding aspects, and where the substrate includes a niobium-based alloy.

Another aspect of the disclosure includes any of the preceding aspects, and where the machine component is a turbine component.

Another aspect of the disclosure includes any of the preceding aspects, and where the turbine component is a component of a gas turbine selected from the group consisting of land-based turbines, marine turbines, aeronautical turbines, and power generation turbines.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

This application contains at least one drawing executed in color. Copies of this patent application publication with color drawing(s) will be provided by the Office upon request and payment of the necessary fee.

These and other features of this disclosure will be more readily understood from the following detailed description of the various aspects of the disclosure taken in conjunction with the accompanying drawings that depict various embodiments of the disclosure, in which:

In FIGS. 4A-4E, the x-axis represents atomic percents of Al (FIG. 4A), Nb (FIG. 4B), Si (FIG. 4C), Ti (FIG. 4D), and Hf (FIG. 4E), respectively, and the y-axis represents equilibrium phase fractions, according to embodiments of the disclosure;

(FIG. 7A) and 100 hours at 1200° C. (FIG. 7B), respectively, according to embodiments of the disclosure;

(FIG. 8A) and 100 hours at 1400° C. (FIG. 8B), respectively, according to embodiments of the disclosure;

Figure 1A:
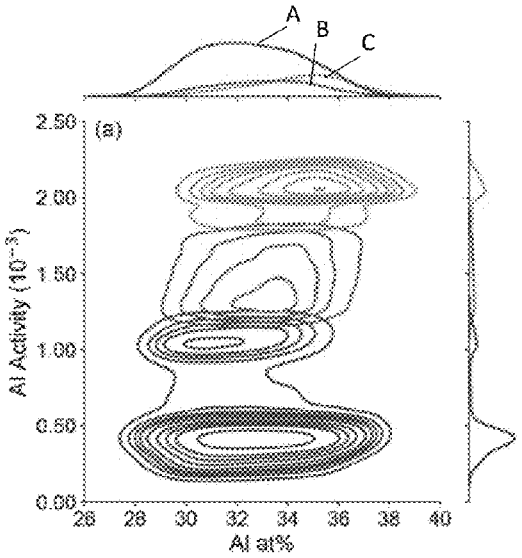
FIGS. 1A-1E include contour maps showing effects of atomic percent (at %) of individual elements on aluminum (Al) activity of about 7800 alloys evaluated at 800° C., where individual elements in FIGS. 1A-1E are Al (FIG. 1A), Nb (FIG. 1B), Si (FIG. 1C), Ti (FIG. 1D), and Hf (FIG. 1E), respectively, according to embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within the current disclosure. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, an impediment to the development of the Nb-based materials for high-temperature applications including gas turbines and gas turbine components is that their environmental resistance, e.g., oxidation behavior, is not always completely satisfactory, especially in order to meet the demanding requirements imposed for applications in hot-section engine components.

Coating compositions are desired for coatings capable of improving the high temperature performance of Nb-based materials. The current disclosure provides a selective oxide-forming coating that is suitable for use as a protective oxide-forming coating on Nb-based substrates, and particularly Nb-based substrates exposed to high temperature and oxidative environments, including the hostile environment of a gas turbine engine. The alloys of the current disclosure are stable up to 1400° C., whereas the conventional alloys are predicted to partially melt by 1400° C. As described in later sections, the alloys of the current disclosure contain primarily two phases (trialuminide and silicide) as opposed to three phases in conventional alloys, which include trialuminide, silicide, and 5-4 silicide. Furthermore, the alloys of the current disclosure have excellent oxidation resistance when being exposed to an oxidation environment at 1200° C. or higher, for example, 1200-1400° C. In some embodiments, the alloys of the current disclosure selectively form a substantially continuous aluminum oxide layer across a surface of the alloy when the alloy is exposed to an oxidation environment at 1200-1400° C.

Examples of Nb-based substrate materials include, but are not limited to, Nb-based alloys and Nb-based RMICs, the latter of which includes niobium-silicide (Nb—Si) composites.

Non-limiting examples of alloys suitable for forming a coating on a Nb-based substrate are described. The alloy(s) may be referred to as "selective oxide-forming alloy(s)" or "Alumina-forming alloy(s)" throughout the disclosure. The coating formed from the alloys of the instant disclosure may be referred to as "selective oxide-forming coating" throughout the disclosure. The elemental composition of the alloy is listed in atomic percent (at %), as embodied by the disclosure.

In embodiments, an alloy of the instant disclosure comprises between 20 atomic percent and 26 atomic percent silicon (Si); between 21 atomic percent and 27 atomic percent titanium (Ti); between 30 atomic percent and 39 atomic percent aluminum (Al); between 2 atomic percent and 10 atomic percent hafnium (Hf); and a balance of niobium (Nb).

In embodiments, the alloy comprises between 20 atomic percent and 24 atomic percent silicon (Si), between 23 atomic percent and 27 atomic percent titanium (Ti), between 30 atomic percent and 37 atomic percent aluminum (Al), between 4 atomic percent and 7 atomic percent hafnium (Hf), and a balance of niobium (Nb).

In embodiments, the alloy comprises between 20 atomic percent and 24 atomic percent silicon (Si), between 21 atomic percent and 27 atomic percent titanium (Ti), between 32 atomic percent and 39 atomic percent aluminum (Al), between 5 atomic percent and 7 atomic percent hafnium (Hf), and a balance of niobium (Nb).

In embodiments, the alloy comprises between 22 atomic percent and 24 atomic percent silicon (Si), between 23 atomic percent and 25 atomic percent titanium (Ti), between 35 atomic percent and 37 atomic percent aluminum (Al), between 5 atomic percent and 7 atomic percent hafnium (Hf), and a balance of niobium (Nb).

In embodiments, the alloy comprises about 23 atomic percent silicon (Si), about 24 atomic percent titanium (Ti), about 36 atomic percent aluminum (Al), about 5 atomic percent hafnium (Hf), and a balance of niobium (Nb).

In embodiments, the atomic percent of silicon (Si) in the alloy of the instant disclosure is a value between about 20 and about 26, such as about 20, about 21, about 22, about 23, about 24, about 25, about 26, or a range between any two of the above values. In non-limiting embodiments, the atomic percent of silicon (Si) in the alloy may be present in a range between 20 and 26 atomic percent, or between 21 and 25 atomic percent, or between 22 and 24 atomic percent, or between 20 and 24 atomic percent.

In embodiments, the atomic percent of titanium (Ti) in the alloy of the instant disclosure is a value between about 21 and about 27, such as about 21, about 22, about 23, about 24, about 25, about 26, about 27, or a range between any two of the above values. In non-limiting embodiments, the atomic percent of titanium (Ti) in the alloy may be present in a range between 21 and 27 atomic percent, or between 22 and 26 atomic percent, or between 23 and 25 atomic percent, or between 23 and 27 atomic percent.

In embodiments, the atomic percent of aluminum (Al) in the alloy of the instant disclosure is a value between about 30 and about 39, such as about 30, about 31, about 32, about 33, about 34, about 35, about 36, about 37, about 38, about 39, or a range between any two of the above values. In non-limiting embodiments, the atomic percent of aluminum (Al) in the alloy may be present in a range between 30 and 39 atomic percent, or between 30 and 37 atomic percent, or between 30 and 36 atomic percent, or between 31 and 38 atomic percent, between 32 and 39 atomic percent, or between 33 and 39 atomic percent, or between 35 and 37 atomic percent, or between 36 and 39 atomic percent.

In embodiments, the atomic percent of hafnium (Hf) in the alloy of the instant disclosure is a value between about 2 and about 10, such as about 2, about 3, about 4, about about 6, about 7, about 8, about 9, about 10, or a range between any two of the above values. In non-limiting embodiments, the atomic percent of hafnium (Hf) in the alloy may be present in a range between 2 and 10 atomic percent, or between 2 and 9 atomic percent, or between 2 and 8 atomic percent, or between 2 and 7 atomic percent, or between 4 and 7 atomic percent, or between 4 and 6 atomic percent, or between 5 and 7 atomic percent, or between 5 and 6 atomic percent.

In embodiments, an alloy of the instant disclosure comprises about 23 atomic percent silicon (Si); about 24 atomic percent titanium (Ti); about 36 atomic percent aluminum (Al); about 5 atomic percent hafnium (Hf); and a balance of niobium (Nb).

Alloy/Coating Composition Design

Various factors were considered when designing the alloys/coating compositions in the current disclosure. The alloys may be referred to as "coating composition(s)" or "composition(s)" and the terms are used interchangeably throughout the disclosure. The factors include, but are not limited to, Al activity, melting behavior, and phase constituents of the alloys/coating compositions.

About 7800 coating compositions were evaluated by analyzing the computationally-predicted thermodynamic properties of each composition. For example, FIGS. 1A-1E include contour maps showing effects of atomic percent (at %) of individual elements in the alloys on the aluminum (Al) activity evaluated at 800° C. The x-axis represents the atomic percent of each element in the compositions, and y-axis represents the Al activity, which is the effective concentration of Al in the respective compositions. Al activity of the compositions evaluated generally fall into three clusters, where the top cluster (green) represents relatively higher Al activity and the middle (teal) and bottom (blue) clusters represent lower Al activity. Higher Al activity indicates that there is a higher likelihood that an aluminum oxide layer would form when the composition is coated on a substrate and exposed to oxidative environments, which would be desirable for applications including but not limited to coating.

Referring to FIG. 1A, the blue, teal, and green curves (A, B, C) on the top of FIG. 1A represent the corresponding populations of Al at % of alloys in each respective blue, teal, and green clusters in the contour maps. As illustrated in FIG. 1A, when the Al at % increases (reading x-axis value left to right), Al activity also increases (as shown by the center points of the blue to teal to green curves shifting to the right, and by the blue to teal to green clusters shifting upward in the contour map). Higher Al at % contributes to higher Al activity at 800° C.

Figure 1B:
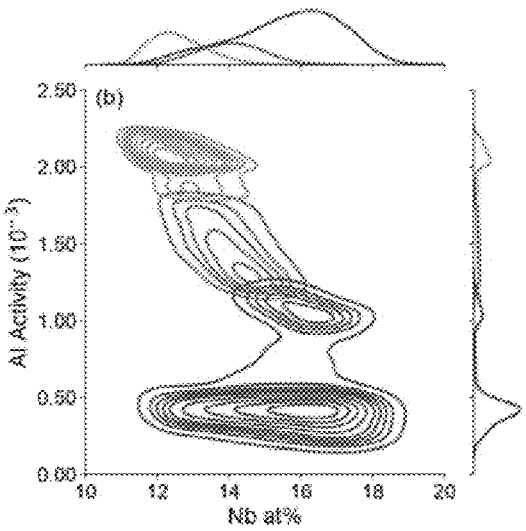

Referring to FIG. 1B, when the average Nb at % decreases (reading x-axis value right to left), Al activity increases (as shown by the blue to teal to green clusters shifting upward in the contour map). Lower Nb at % contributes to higher Al activity at 800° C.

Figure 1C:
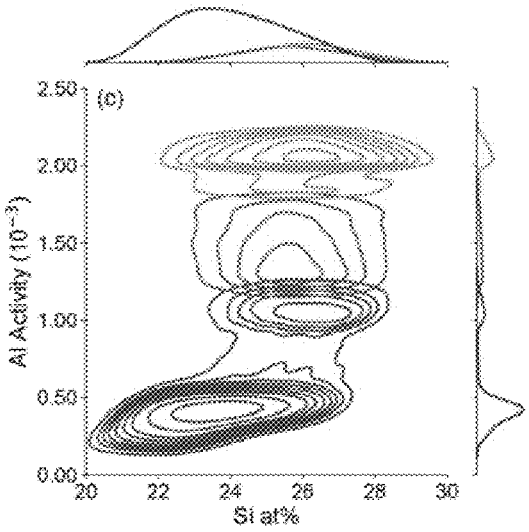
Figure 1D:
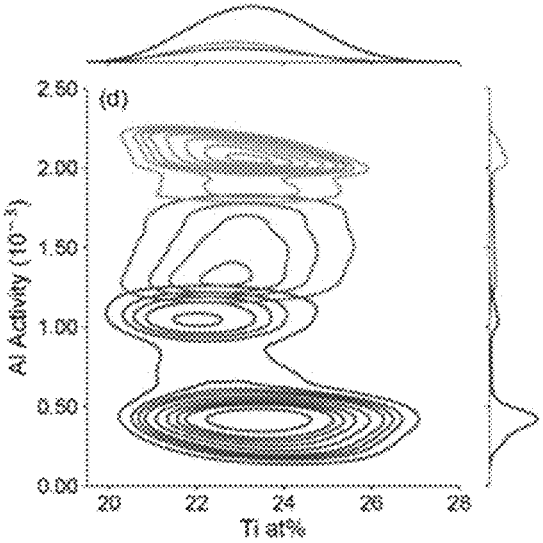
Figure 1E:
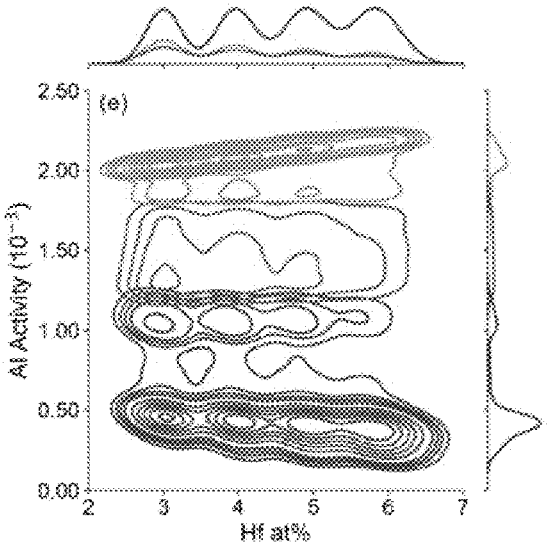
Figure 2A:
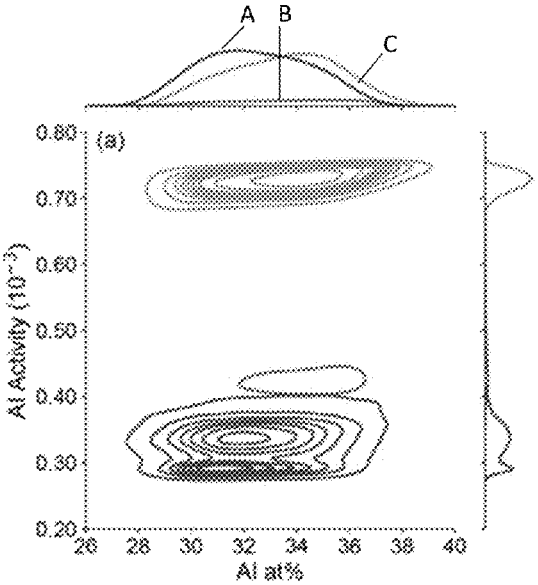
FIGS. 2A-2E include contour maps showing effects of atomic percent (at %) of individual elements on aluminum (Al) activity of the 7800+ alloys evaluated at 1400° C., where individual elements in FIGS. 2A-2E are Al (FIG. 2A), Nb (FIG. 2B), Si (FIG. 2C), Ti (FIG. 2D), and Hf (FIG. 2E), respectively, according to embodiments of the disclosure.
Figure 2B:
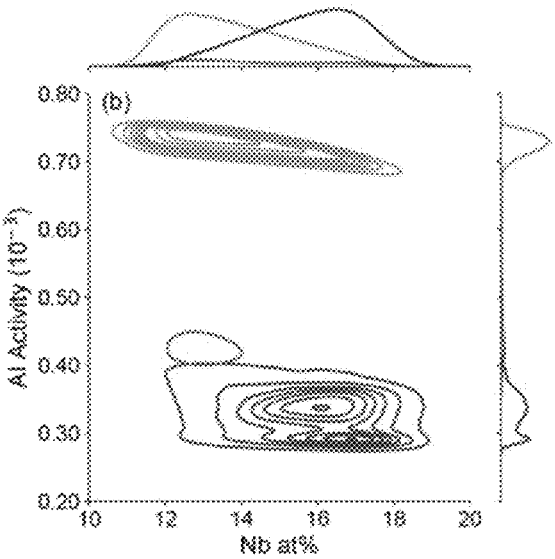
Figure 2C:
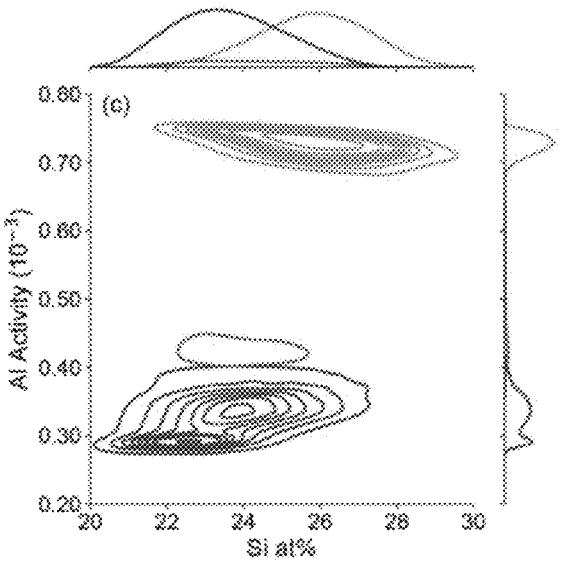
Figure 2D:
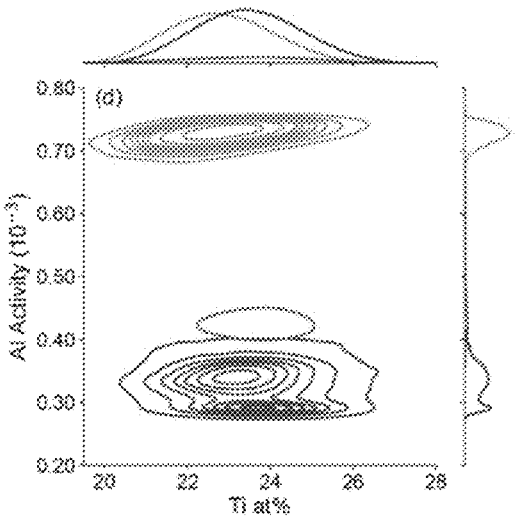
Figure 2E:
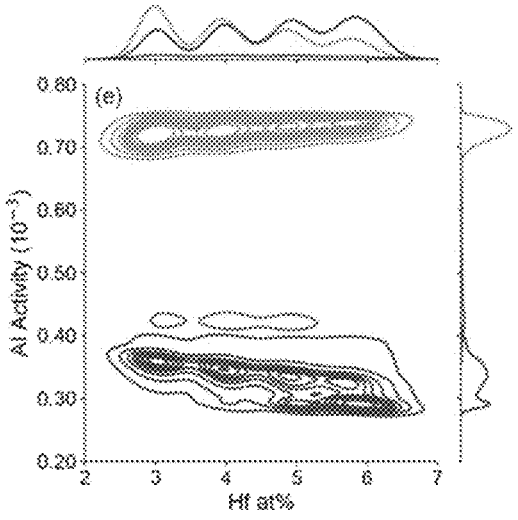

Applying similar analysis, FIG. 1C suggests that when Si is in a range of 20-26 at %, higher Si at % contributes to higher Al activity at 800° C. FIGS. 1D and 1E shows that changing atomic percents of Ti or Hf does not appear to have significant contribution to higher Al activity.

FIGS. 2A-2E include analysis of the same 7800 alloys/coating compositions as used in FIGS. 1A-1E, with the difference being that the temperature in FIGS. 2A-2E is 1400° C. Similarly, Al activity of the alloys evaluated generally fall into three clusters, where the top cluster (green) represents relatively higher Al activity and the middle (teal) and bottom (blue) clusters represent lower Al activity. Effects of atomic percent of each element on the Al activity as shown in FIGS. 2A-2E were similar to the effects observed in corresponding FIGS. 1A-1E and are omitted here for brevity.

Figure 3:
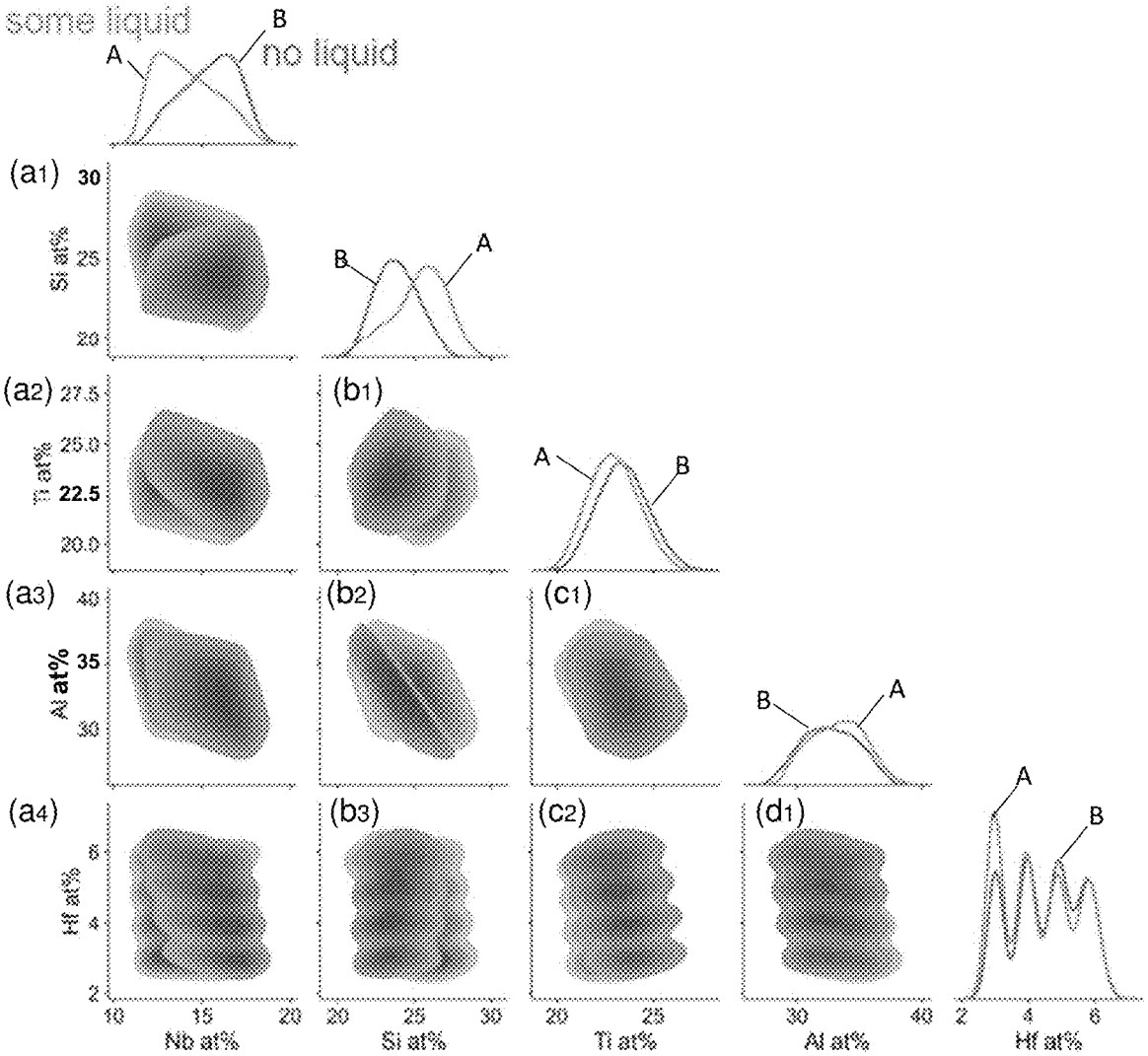
FIG. 3 includes plots showing effects of atomic percents of elements on the melting behaviors of the 7800+ alloys at 1400° C., according to embodiments of the disclosure.

The computationally-predicted thermodynamic phase constitution of the same group of 7800 alloys/coating compositions were evaluated at 1400° C. Each plot in FIG. 3 represents alloys having elements with atomic percents that fall into the specified respective ranges. For example, in ($a_1$), the atomic percent range of Nb (as represented by x-axis value) is 10-20 at %, and the atomic percent range of Si (as represented by y-axis value) is 20-30 at %. Similarly, ($a_2$) represents alloys including Nb 10-20 at % and Ti 20-27.5 at %, and ($b_1$) represents alloys including Si 20-30 at % and Ti 20-27.5 at %. Descriptions for other plots can be similarly derived and are omitted here for brevity.

In these pairwise plots, the alloys remaining fully solid at 1400° C. and those forming some liquid are represented in green and orange ball-shaped clusters in the plots, respectively. The green and oranges curves on the top of the first column represents the populations of the Nb at % of all the alloys in the respective green and orange clusters in the plots ($a_1$)-($a_4$). Similarly, the curves on the top of the second, third, and fourth column represents populations of the Si at %, Ti at %, Al at %, of all the alloys in their respective green and orange clusters. The curves on the fifth column represents populations of the Hf at % of all the alloys in their respective green and orange clusters (based on green and orange clusters shown from left to right, for example, $a_4$, $b_3$, $c_2$, $d_1$).

By comparing plots ($a_1$)-($a_4$), it shows that the alloys that have no liquid form (green clusters) have higher Nb at % than the alloys that have some liquid form (orange clusters), as indicated by the green curve shifting to the right along the x-axis. Melting is less likely for alloys with higher Nb at %.

Similarly, comparing plots ($b_1$)-($b_3$), it shows that the alloys that form no liquid (green clusters) have lower Si at % than the alloys that form some liquid (orange clusters), as indicated by the green curve shifting to the left. Melting is less likely for alloys with lower Si at %. Comparing plots ($c_1$) and ($c_2$), it shows that the alloys that form no liquid (green clusters) have slightly higher Ti at % than the alloys that form some liquid (orange clusters), as indicated by the green curve shifting slightly to the right. The effect of Ti at % on the melting behavior of the alloys is modest. Similarly, effects of Al at % (as indicated by plot ($d_1$) and corresponding curves) and Hf at % on the melting behavior of the alloys are modest.

FIG. 3 also provides a few important insights as to the alloy design. As indicated by plot ($b_2$), a narrow region of thermostability exists for Al and Si. In plot ($b_2$), the alloys include Al with atomic percent in a range of 30-40 at % and Si in a range of 20-30 at %. When Al at % is in an upper end of the range, Si at % needs to be in a lower end of the range in order for the alloys to stay in the green clusters. On the other hand, when Si at % is in an upper end of the range, Al at % needs to be in a lower end of the range in order for the alloys to stay in the green clusters. When both Al and Si are on the higher end of their ranges, the alloys tend to melt (orange clusters). Therefore, alloys may be designed to include high Al or high Si, for favorable melting behaviors, but alloys that have both Al and high Si at % may not be desirable for favorable thermostability.

Furthermore, as discussed earlier with respect to FIGS. 1A-1E and 2A-2E, lower Nb at % contributes to higher Al activity at 800° C. and 1400° C. As indicated in FIG. 3, while higher Nb at % is desirable for favorable thermostability of the alloys (as discussed earlier), lower Nb at % may be accommodated if it is accompanied by lower Si (plot $a_1$), higher Ti (plot $a_2$), and higher Hf (plot $a_3$).

The observations revealed in the evaluation of the 7800+ alloys/coating compositions are surprising and important. Through rational designs aided by these observations, the inventors of the current disclosure were able to develop a desirable elemental composition space of the alloys of the current disclosure. These data discussed above and throughout the disclosure, once again demonstrate that designing alloys with suitable profiles including but not limited to oxidation resistance, thermostability, and microstructure requires carefully balanced consideration of various factors and complex interplay between those factors.

FIGS. 4A-4E show effects of varying atomic percents of elements on phase equilibria at 1400° C. for a non-limiting example of a selected alloy of the disclosure, $Nb_{12}Si_{23}Ti_{24}Al_{36}Hf_5$. In FIGS. 4A-4E, the x-axis represents value of the atomic percent of Al (FIG. 4A), Nb (FIG. 4B), Si (FIG. 4C), Ti (FIG. 4D), and Hf (FIG. 4E), respectively, and the y-axis represents mole fractions of various phases of corresponding alloys at equilibrium. Also shown in each of FIGS. 4A-4E is a generic formula for the alloys represented in the respective figure. For example, in FIG. 4A, the alloy has a generic formula of $Al_x(Nb_{12}Si_{23}Ti_{24}Hf_5)_{(100(64+x))}$. The middle dash line represents the selected alloy $Nb_{12}Si_{23}Ti_{24}Al_{36}Hf_5$, where the atomic percent of element Nb, Si, Ti, Al and Hf is 12, 23, 24, 36, and 5, respectively. Moving from the middle line toward the left, the atomic percent of Al decreases from 36 at % to 26 at %, and from the middle line toward the right, the atomic percent of Al increases from 36 at % to 46 at %. While the atomic percent of Al is changed, the ratio among the atomic percents of other elements is kept constant, that is, 12:23:24:5 for Nb:Si:Ti:Hf for alloys in FIG. 4A. For example, when Al is 41 at %, the alloys of FIG. 4A have a formula of $Al_{41}(Nb_{12}Si_{14}Ti_{24}Hf_5)_{0.95}$ or $Al_{41}Nb_{11.4}Sn_{3.3}Ti_{22.8}Hf_{4.8}$. Similarly, in FIGS. 4B, 4C, 4D, and 4E, the alloys have a generic formula of $Nb_x(Si_{23}Ti_{24}Al_{36}Hf_5)_{(100/(88+x))}$, $Si_x(Nb_{12}Ti_{24}Al_{36}Hf_5)_{100(77+x))}$, $Ti_x(Nb_{12}Si_{23}Al_{36}Hf_5)_{(100/(76+x))}$, and $Hf_x(Nb_{12}Si_{23}Ti_{24}Al_{36})_{100(95+x))}$, respectively, the detailed descriptions of which are similar to the ones described for FIG. 4A and are omitted here for brevity.

In the figures, y-axis represents mole fraction of various phases at equilibrium. The phases of the alloys include $MAl_3$ trialuminide phase (Nb, Ti)$Al_3$ (also referred to as "trialuminide"), $MsSi_4$ silicide phase $(Nb, Ti, Hf)_5Si_4$ (also referred to as "5-4 silicide"), $MsSi_3$ silicide phase $(Nb, Ti, Hf)_5Si_3$ (also referred to as "5-3 silicide") with hexagonal structure ("5-3 silicide (h)"), $MsSi_3$ silicide phase $(Nb, Ti, Hf)_5Si_3$ with tetragonal structure ("5-3 silicide (t)"), and liquid phase due to melting of the alloys ("liquid") shown in each respective color in FIGS. 4A-4E, where same color represents the same type of phase. The range of the element composition in each of FIGS. 4A-4E was chosen so that one end of the range is defined by the onset of melting when the concentration of one of the elements is increased and/or decreased while the ratio of the rest of the elements in the alloy remain constant, and the other end of the range selected by maintaining high concentrations of the trialuminide and 5-4 silicide (i.e., minimize the 5-3 silicide).

Figure 4A:
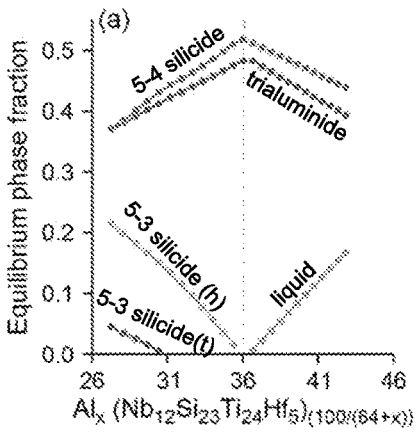
FIGS. 4A-4E show effects of varying atomic percents of individual elements on phase equilibria at 1400° C. for a non-limiting example of selected alloy of the disclosure, $Nb_{12}Si_{23}Ti_{24}Al_{36}Hf_5$.

The phases of $Nb_{12}Si_{23}Ti_{24}Al_{36}Hf_5$ is shown in the middle of each of FIGS. 4A-4E. The $Nb_{12}Si_{23}Ti_{24}Al_{36}Hf_5$ alloy exist primarily in two phases: trialuminide and 5-4 silicide phases, and no 5-3 silicide (h), 5-3 silicide (t), or liquid phase is observed. For the alloys evaluated in FIG. 4A, the atomic percent of Al is in a range of 26-46 at %. As the Al at % increases from 36 at % toward 46 at %, more melting occurs in the alloys, as indicated by the increased amount of liquid phase. When Al at % decreases from 36 at % toward 26 at %, no melting is observed, yet 5-3 silicide (h), 5-3 silicide (t) phases start to form. The inventors have discovered that there is a narrow and unique window for the alloys to exist primarily in the two-phase space including the trialuminide and 5-4 silicide phases. For example, as illustrated in FIG. 4A, the alloys of $Al_x(Nb_{12}Si_{23}Ti_{24}Hf_5)_{(100(64+x))}$ with Al in a range of 30-39 at %, or 30-37 at %, or 31-41 at %, or 32-39 at %, or 35-37 at %, or about 36 at % exist primarily in trialuminide and 5-4 silicide phases, with a small fractions in 5-3 silicide phases or liquid phase. It is to be understood that the ranges described above (and the ranges described with respect to FIGS. 4B-4E) are provided as non-limiting examples and are not limited to the listed ranges.

Figure 4B:
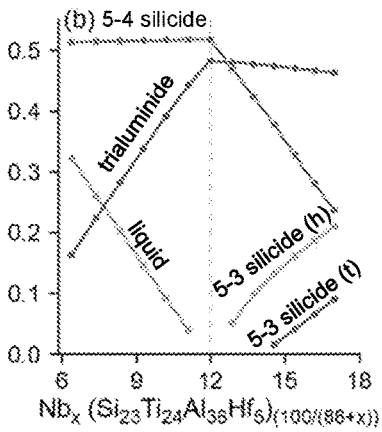

Alloys in FIG. 4B have a generic formula of $Nb_x(Si_{23}Ti_{24}Al_{36}Hf_5)_{(100(88+x))}$. Similarly, FIG. 4B also shows there is a narrow and unique window for the alloys to exist primarily in trialuminide and 5-4 silicide phases, with a small fractions in 5-3 silicide phases or liquid phase. For example, as illustrated in FIG. 4B, the alloys of $Nb_x(Si_{23}Ti_{24}Al_{36}Hf_5)_{(100(88+x))}$ with Nb is in a range of 7-18 at %, the alloys exists primarily in trialuminide and 5-4 silicide phases, with a small fractions in 5-3 silicide phases or liquid phase.

Figure 4C:
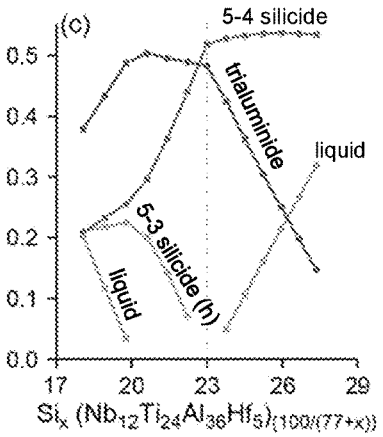

As illustrated in FIG. 4C, the alloys of $Si_x(Nb_{12}Ti_{24}Al_{36}Hf_5)_{(100(77+x))}$ with Si in a range of 20-26 at %, or 20-24 at %, or 22-24 at %, or about 23 at % exist primarily in trialuminide and 5-4 silicide phases, with a small fractions in 5-3 silicide phases or liquid phase.

Figure 4D:
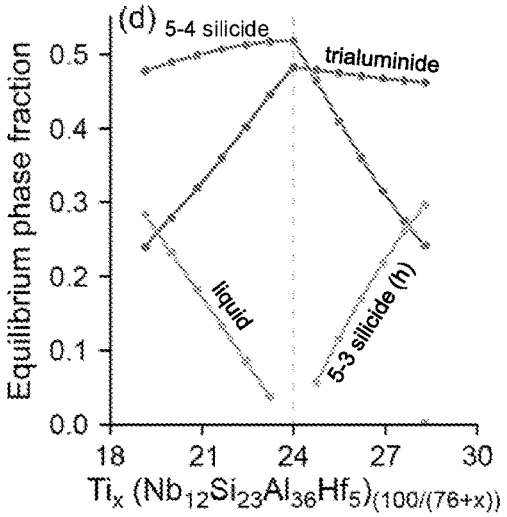

As illustrated in FIG. 4D, the alloys of $Ti_x(Nb_{12}Si_{23}Al_{36}Hf_5)_{(100(76+x))}$ with Ti in a range of 21-27 at %, or 23-27 at %, or 23-25 at %, or about 24 at %, the alloys exists primarily in trialuminide and 5-4 silicide phases, with a small fractions in 5-3 silicide phases or liquid phase.

Figure 4E:
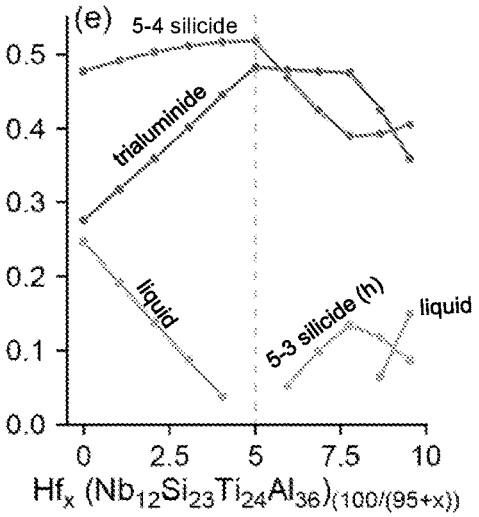

As illustrated in FIG. 4E, the alloys of $Hf_x(Nb_{12}Si_{23}Ti_{24}Al_{36})_{(100(95+x))}$ with Hf in a range of 2-10 at %, 2-7 at %, or 4-7 at %, or 5-7 at %, or at about 5 at % exist primarily in trialuminide and 5-4 silicide phases, with a small fractions in 5-3 silicide phases or liquid phase.

FIGS. 4A-4E further demonstrate that designing alloys with suitable profiles requires carefully balanced consideration of various factors.

Figure 5:
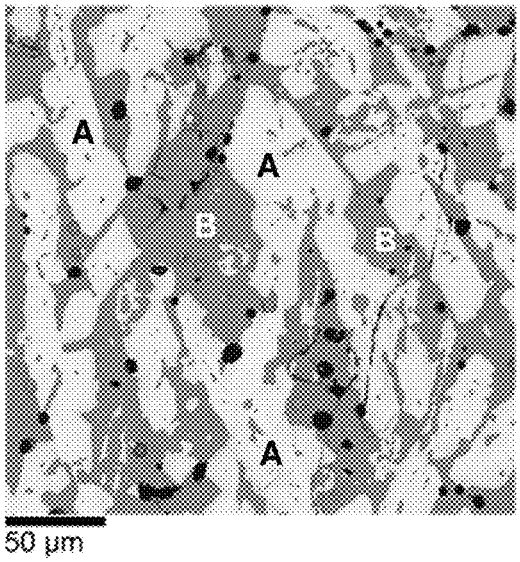
FIG. 5 is a scanning electron micrograph (SEM) showing microstructure of a cross section of a bulk ingot of a non-limiting example of alloy, away from the oxidized surface, after the bulk ingot was exposed to oxidation environment for 100 hours at 1200° C., according to embodiments of the disclosure.
Figure 6:
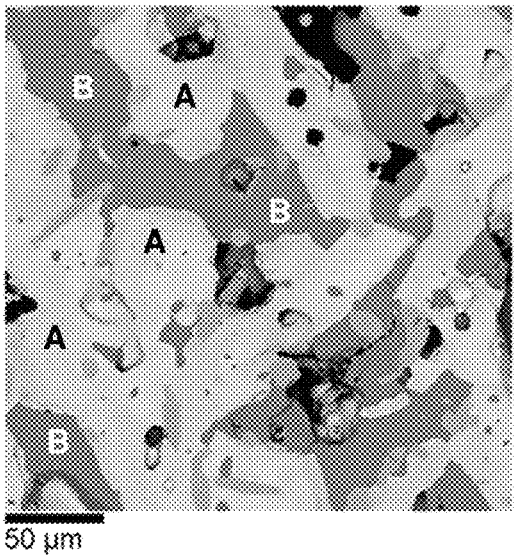
FIG. 6 is a scanning electron micrograph (SEM) showing microstructure of a cross section of a bulk ingot of a non-limiting alloy, after the bulk ingot was exposed to oxidation environment for 100 hours at 1400° C., according to embodiments of the disclosure.

Turning to FIGS. 5 and 6, which are scanning electron micrograph (SEM) showing microstructure of a surface of a bulk ingot of a non-limiting alloy of the instant disclosure. For the SEM studies, the bulk ingot of the alloy is cut into pieces, polished, cross-sectioned, and polished for subsequent exposure to oxidation, prior to the microstructure measurements. During the oxidation experiments, the alloy sample was heated in lab air in a box furnace with 20° C./min ramps. The measurements were taken after the bulk ingot was exposed to oxidation environment for 100 hours at 1200° C. (FIG. 5) and 1400° C. (FIG. 6), respectively. In both FIGS. 5 and 6, the two primary phases observed are 5-4 silicide phase (representative bright regions labelled as "A") and trialuminide phase (representative medium gray regions labelled as "B").

Table 1 shows elemental composition (in atomic percent, at %) of the 5-4 silicide phase and trialuminide phase in FIG. 5. The elemental composition was measured by energy dispersive spectroscopy (EDS), according to embodiments of the disclosure.

TABLE 1

| | 5-4 Silicide | Trialuminide |
|---|---|---|
| Nb | 15 | 12 |
| Si | 45 | 0 |
| Ti | 20 | 10 |
| Al | 2 | 77 |
| Hf | 17 | 1 |

Table 2 shows elemental composition (in atomic percent, at %) of the 5-4 silicide phase and trialuminide phase in FIG. 6. The elemental composition was measured by energy dispersive spectroscopy (EDS), according to embodiments of the disclosure.

TABLE 2

| | 5-4 Silicide | Trialuminide |
|---|---|---|
| Nb | 16 | 11 |
| Si | 45 | 2 |
| Ti | 21 | 12 |
| Al | 2 | 75 |
| Hf | 16 | 1 |

The examples in the tables above are non-limiting examples. In certain embodiments, the (Nb, Ti)$Al_3$ phase includes between 6 atomic percent and 26 atomic percent niobium (Nb), between 1 atomic percent and 5 atomic percent silicon (Si), between atomic percent and 16 atomic percent titanium (Ti), between 71 atomic percent and 77 atomic percent aluminum (Al), and about 1 atomic percent hafnium (Hf). In embodiments, the (Nb, Ti, Hf)$_5Si_4$ phase includes between 13 atomic percent and 19 atomic percent niobium (Nb), between 42 atomic percent and 48 atomic percent silicon (Si), between 19 atomic percent and 25 atomic percent titanium (Ti), between 1 atomic percent and 3 atomic percent aluminum (Al), and between 12 atomic percent and 18 atomic percent hafnium (Hf).

Figure 7A:
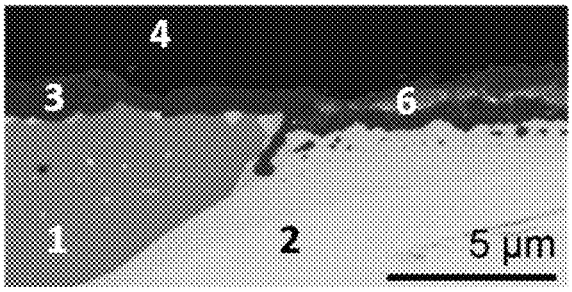
FIGS. 7A and 7B are scanning electron micrographs of the microstructure of a cross section of a bulk ingot of a non-limiting example of alloy, after the alloy is exposed to oxidation environment for 1 hour at 1200° C.
Figure 8A:
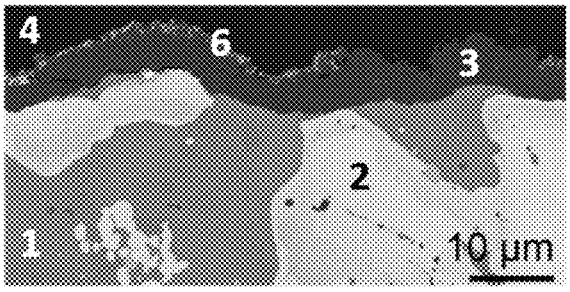
FIGS. 8A and 8B are scanning electron micrographs of the microstructure of a cross section of a bulk ingot of a non-limiting example of alloy, after the alloy is exposed to oxidation environment for 1 hour at 1400° C.
Figure 7B:
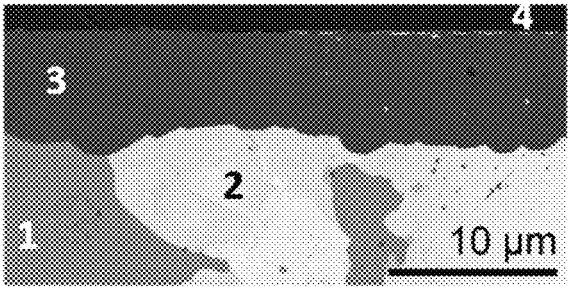
Figure 8B:
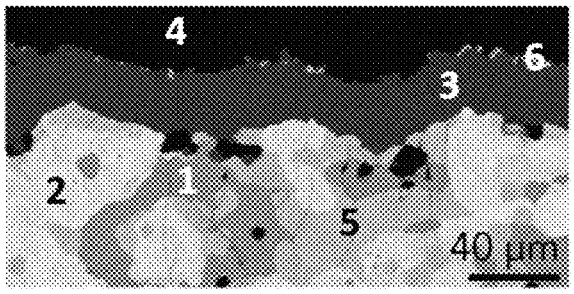

FIGS. 7A, 7B, 8A, and 8B are scanning electron micrographs of the microstructure of a cross section of a bulk ingot of a non-limiting example of alloy of the disclosure, after the alloy is exposed to oxidation environment for 1 hour at 1200° C. (FIG. 7A), 100 hours at 1200° C. (FIG. 7B), 1 hour at 1400° C. (FIG. 8A), 100 hours at 1400° C. (FIG. 8B), respectively. The phases identified in FIGS. 7A, 7B, 8A, and 8B include: trialuminide (1), silicide (2), aluminum oxide $Al_2O_3$(3, also referred to as "Al-rich oxide"), epoxy (4), silicide (5), and discrete particles of mixed oxides of Nb, Si, Ti, and/or Hf (6, also referred to as "Al-lean oxide"). It is hypothesized that the mixed oxides of Nb, Si, Ti, and/or Hf (6) formed early in the oxidation process, and were covered by the subsequently formed aluminum oxide $Al_2O_3$ (3). It is further hypothesized that the growth of mixed oxides of Nb, Si, Ti, and/or Hf stops once a continuous layer of aluminum oxide $Al_2O_3$(3) forms, as shown in FIGS. 7B and 8B.

FIGS. 7A, 7B, 8A, and 8B demonstrate the selective oxide-forming ability of the alloy of the disclosure at high temperatures including but not limited to 1200° C. and 1400° C. As shown in FIGS. 7A and 8A, aluminum oxide $Al_2O_3$(3) forms quickly and as a continuous layer by as little as 1 hour at 1200° C. (FIG. 7A) and 1400° C. (FIG. 8A). The continuous layer aluminum oxide $Al_2O_3$(3) is still stable at 100 hours at 1200° C. (FIG. 7B) and 1400° C. (FIG. 8B).

Surprisingly, as shown in FIGS. 7A, 7B, 8A, and 8B, substantially continuous aluminum oxide layer (3) was formed across a region including (Nb, Ti, Hf)$_5Si_4$ phase (2) and (Nb, Ti)$Al_3$ phase (1). Even on top of the region that primarily includes (Nb, Ti, Hf)$_5Si_4$ phase, continuous aluminum oxide layer (3) could be formed. The result is surprising because the region that primarily includes (Nb, Ti, Hf)$_5Si_4$ phase presumably does not have substantial atomic percent of aluminum (Al) as a source for forming aluminum oxide layer over the (Nb, Ti, Hf)$_5Si_4$ phase (2). It is hypothesized that the oxide layer initially formed over the (Nb, Ti, Hf)$_5Si_4$ phase (2) includes oxides of Nb, Si, Ti, or Hf present as discrete particles in the (Nb, Ti, Hf)$_5Si_4$ phase. And as more aluminum oxide is preferably formed in the trialuminide phase (1), the aluminum oxide layer (3) continues to grow over the initially formed oxide layer (6), and forms a substantially continuous layer across the region including (Nb, Ti)$Al_3$ phase (1) and (Nb, Ti, Hf)$_5Si_4$ phase (2).

In some embodiments, aluminum oxide layer has a thickness of more than about 5 μm. In some embodiments, aluminum oxide layer has a thickness of between about 5 μm and about 7 μm.

The selective oxide-forming alloys of the current disclosure can be used in forming a protective coating for applications that require high temperature (e.g., at about 1400° C. or higher). For example, in non-limiting embodiments, the protective coating of the instant disclosure can be used on a substrate exposed to high temperatures. In embodiments, the substrate may be a substrate exposed to hostile environments of a gas turbine engine. In embodiments, the substrate is a Nb-based substrate. In embodiments, the substrate is a Nb-based substrate used in turbines or turbine components. In some embodiments, the turbine component is one or more of a blade, a rotor, or a nozzle. In certain embodiments, the gas turbine is selected from the group consisting of land-based turbines, marine turbines, aeronautical turbines, and power generation turbines.

Figure 9:
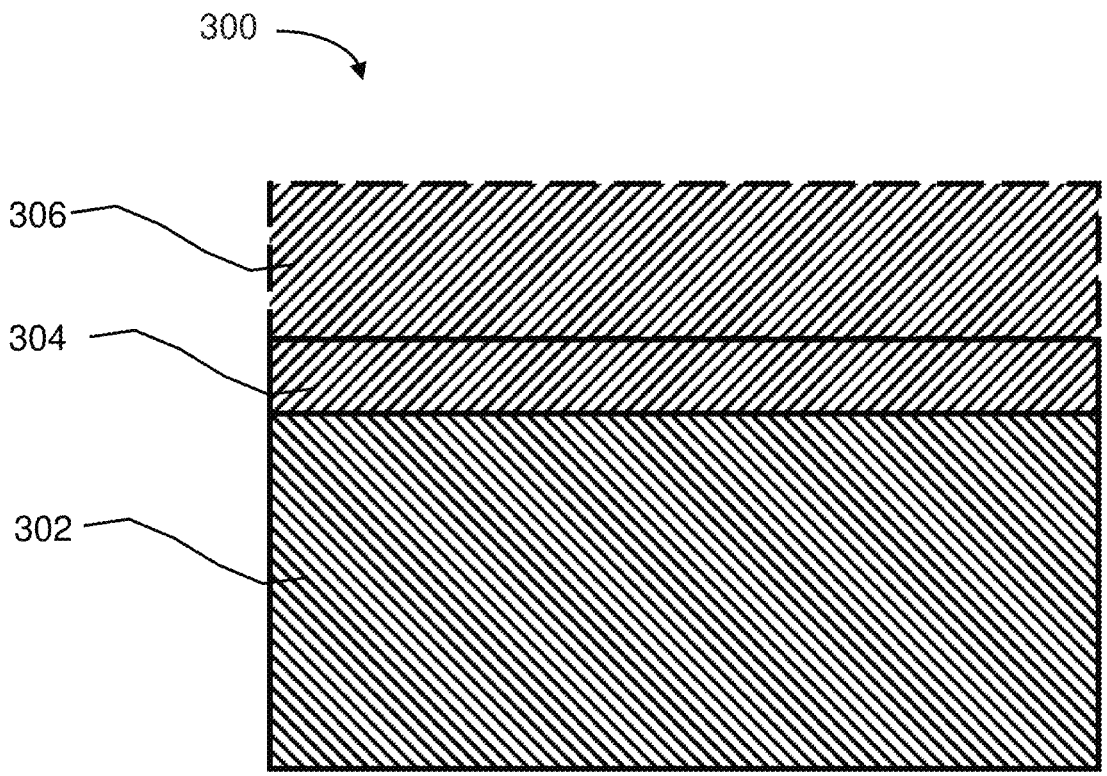
FIG. 9 is a schematic sectional view of a machine component with a coating of an alloy of the disclosure formed thereon, according to embodiments of the disclosure.

FIG. 9 is a schematic sectional view of a machine component 300 with a coating including an alloy of the instant disclosure formed thereon. Machine component 300 may include a substrate 302 having a coating 304 thereon. Coating 304 can be formed from an alloy of the current disclosure. In some embodiments, coating 304 includes an alloy that includes between 20 atomic percent and 26 atomic percent silicon (Si); between 21 atomic percent and 27 atomic percent titanium (Ti); between 30 atomic percent and 39 atomic percent aluminum (Al); between 2 atomic percent and 10 atomic percent hafnium (Hf); and a balance of niobium (Nb). In embodiments, Machine component 300 may optionally include an additional layer of thermal barrier coating (TBC) 306 (shown as dashed lines) disposed on top of coating 304. In embodiments, TBC layer 306 may have a thickness greater than that of coating 304. Thermal barrier coating (TBC) 306 may include any currently know or later developed TBC materials that are suitable for providing further protection to the coating. Machine component 300 may be subjected to high temperatures, for example temperatures encountered by a hot gas path component in turbines. Hot gas path components include, but are not limited to, combustion liners, transition pieces, turbine nozzles, and turbine blades (also known as "turbine buckets").

Figure 10:
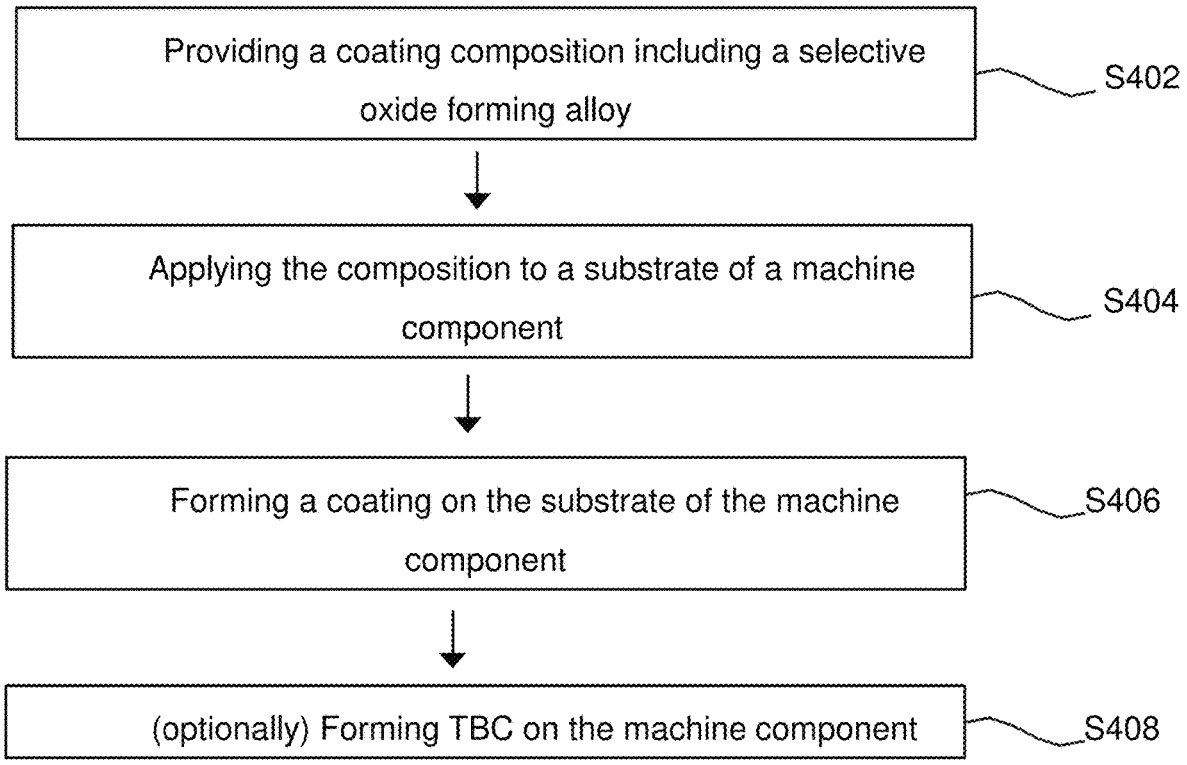
FIG. 10 is a flow diagram of a method of coating a machine component with an alloy of the disclosure coated thereon, according to embodiments of the disclosure.

FIG. 10 is a flow diagram of a method of coating a machine component 300 (FIG. 9) with coating 304 (and optionally TBC 306) coated thereon. The method includes providing a coating composition 400 including a selective oxide-forming alloy of the instant disclosure at step S402, applying coating composition 400 to substrate 302 of machine component 300 at step S404, and forming coating 304 on substrate 302 at step S406. The method may include an optional step S408 of forming TBC 306 on machine component 300 by disposing TBC on top of coating 304. The selective oxide-forming alloy may include between 20 atomic percent and 26 atomic percent silicon (Si); between 21 atomic percent and 27 atomic percent titanium (Ti); between 30 atomic percent and 39 atomic percent aluminum (Al); between 2 atomic percent and 10 atomic percent hafnium (Hf); and a balance of niobium (Nb). Applying coating composition 400 to substrate 302 may include applying or depositing coating composition 400 onto one or more surfaces of substrate 302 using currently known or later developed deposition techniques including, but not limited to, thermal spraying (e.g., plasma, flame, or high velocity oxygen fuel (HVOF)), high velocity air fuel (HVAF) spray, sputtering, electron beam physical vapor deposition (EBPVD), or chemical vapor deposition, or combinations thereof.

Applying coating composition 400 onto substrate 302 (e.g., using a thermal spray) forms coating 304. Coating 304 of machine component 300 may include a microstructure that includes a (Nb, Ti)$Al_3$ phase and a (Nb, Ti, Hf)$_5Si_4$ phase, as described earlier with respect to FIGS. 4A-4E, 5, 6, 7A, 7B, 8A, and 8B.

Forming coating 304 on substrate 302 may additionally include thermally treating coating 304 (e.g., heating) to generate aluminum oxide layer. Aluminum oxide layer (3, FIG. 7A, 8A, 7B, 8B) may be formed above and across a region including (Nb, Ti)$Al_3$ phase and (Nb, Ti, Hf)$_5Si_4$ phase. In some embodiments, aluminum oxide layer may have a thickness of more than about 1 μm. In some embodiments, aluminum oxide layer may have a thickness including, but not limited to, a thickness with a range of between 1 μm and 30 μm, or between 1 μm and 20 μm, or between 1 μm and 15 μm, or between 1 μm and 10 μm, or between 5 μm and 30 μm, or between 5 μm and 20 μm, or between 5 μm and 15 μm, or between 5 μm and 10 μm, or between 15 μm and 30 μm.

The foregoing drawings show some of the processing associated according to several embodiments of this disclosure. In this regard, each drawing or block within a flow diagram of the drawings represents a process associated with embodiments of the method described. It should also be noted that in some alternative implementations, the acts noted in the drawings or blocks may occur out of the order noted in the figure or, for example, may in fact be executed substantially concurrently or in the reverse order, depending upon the act involved. Also, one of ordinary skill in the art will recognize that additional blocks that describe the processing may be added.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "About," "approximately," and "substantially," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. An alloy comprising:

between 20 atomic percent and 26 atomic percent silicon (Si);

between 21 atomic percent and 27 atomic percent titanium (Ti);

between 32 atomic percent and 39 atomic percent aluminum (Al);

between 5 atomic percent and 10 atomic percent hafnium (Hf); and a balance of niobium (Nb).

2. The alloy of claim 1, wherein the alloy comprises between 20 atomic percent and 24 atomic percent silicon (Si), between 23 atomic percent and 27 atomic percent titanium (Ti), between 32 atomic percent and 37 atomic percent aluminum (Al), between 5 atomic percent and 7 atomic percent hafnium (Hf), and a balance of niobium (Nb).

3. The alloy of claim 1, wherein the alloy comprises between 20 atomic percent and 24 atomic percent silicon (Si), between 21 atomic percent and 27 atomic percent titanium (Ti), between 32 atomic percent and 39 atomic percent aluminum (Al), between 5 atomic percent and 7 atomic percent hafnium (Hf), and a balance of niobium (Nb).

4. The alloy of claim 1, wherein the alloy comprises between 22 atomic percent and 24 atomic percent silicon (Si), between 23 atomic percent and 25 atomic percent titanium (Ti), between 35 atomic percent and 37 atomic percent aluminum (Al), between 5 atomic percent and 7 atomic percent hafnium (Hf), and a balance of niobium (Nb).

5. The alloy of claim 1, wherein the alloy comprises about 23 atomic percent silicon (Si), about 24 atomic percent titanium (Ti), about 36 atomic percent aluminum (Al), about 5 atomic percent hafnium (Hf), and a balance of niobium (Nb).

6. The alloy of claim 1, wherein the alloy forms a substantially continuous aluminum oxide layer across a surface of the alloy when the alloy is exposed to an oxidation environment at 1200° C. or higher.

7. The alloy of claim 1, wherein the alloy has a microstructure including a (Nb, Ti)$Al_3$ phase and a (Nb, Ti, Hf)$_5Si_4$ phase.

8. The alloy of claim 7, wherein the (Nb, Ti)$Al_3$ phase includes:

between 6 atomic percent and 12 atomic percent niobium (Nb);

between 1 atomic percent and 5 atomic percent silicon (Si);

between 10 atomic percent and 16 atomic percent titanium (Ti);

between 71 atomic percent and 77 atomic percent aluminum (Al); and about 1 atomic percent hafnium (Hf).

9. The alloy of claim 7, wherein the (Nb, Ti, Hf)$_5Si_4$ phase includes:

between 13 atomic percent and 19 atomic percent niobium (Nb);

between 42 atomic percent and 48 atomic percent silicon (Si);

between 19 atomic percent and 25 atomic percent titanium (Ti);

between 1 atomic percent and 3 atomic percent aluminum (Al); and between 12 atomic percent and 18 atomic percent hafnium (Hf).

10. A coating composition comprising:

an alloy including:

between 20 atomic percent and 26 atomic percent silicon (Si);

between 21 atomic percent and 27 atomic percent titanium (Ti);

between 32 atomic percent and 39 atomic percent aluminum (Al);

between 5 atomic percent and 10 atomic percent hafnium (Hf); and a balance of niobium (Nb).

11. The coating composition of claim 10, wherein the alloy comprises between 20 atomic percent and 24 atomic percent silicon (Si), between 23 atomic percent and 27 atomic percent titanium (Ti), between 32 atomic percent and 37 atomic percent aluminum (Al), between 5 atomic percent and 7 atomic percent hafnium (Hf), and a balance of niobium (Nb).

12. The coating composition of claim 10, wherein the alloy comprises between 20 atomic percent and 24 atomic percent silicon (Si), between 21 atomic percent and 27 atomic percent titanium (Ti), between 32 atomic percent and 39 atomic percent aluminum (Al), between 5 atomic percent and 7 atomic percent hafnium (Hf), and a balance of niobium (Nb).

13. The coating composition of claim 10, wherein the coating includes a substantially continuous aluminum oxide layer across a surface of the alloy when being exposed to a temperature of 1200° C. or higher.

14. The coating composition of claim 10, wherein the alloy has a microstructure including a (Nb, Ti)$Al_3$ phase and a (Nb, Ti, Hf)$_5Si_4$ phase.

15. A machine component comprising:

a substrate having a coating thereon, the coating including an alloy that includes:

between 20 atomic percent and 26 atomic percent silicon (Si);

between 21 atomic percent and 27 atomic percent titanium (Ti);

between 32 atomic percent and 39 atomic percent aluminum (Al);

between 5 atomic percent and 10 atomic percent hafnium (Hf); and a balance of niobium (Nb).

16. The machine component of claim 15, wherein the alloy comprises between 20 atomic percent and 24 atomic percent silicon (Si), between 23 atomic percent and 27 atomic percent titanium (Ti), between 32 atomic percent and 37 atomic percent aluminum (Al), between 5 atomic percent and 7 atomic percent hafnium (Hf), and a balance of niobium (Nb).

17. The machine component of claim 15, wherein the alloy comprises between 20 atomic percent and 24 atomic percent silicon (Si), between 21 atomic percent and 27 atomic percent titanium (Ti), between 32 atomic percent and 39 atomic percent aluminum (Al), between 5 atomic percent and 7 atomic percent hafnium (Hf), and a balance of niobium (Nb).

18. The machine component of claim 15, wherein the substrate includes a niobium-based alloy.

19. The machine component of claim 15, wherein the machine component is a turbine component.

20. The machine component of claim 19, wherein the turbine component is a component of a turbine selected from the group consisting of land-based turbines, marine turbines, aeronautical turbines, and power generation turbines.

* * * * *